US007685744B2

(12) United States Patent
Lundy, Jr. et al.

(10) Patent No.: US 7,685,744 B2
(45) Date of Patent: Mar. 30, 2010

(54) ARCH SUPPORT INSOLE

(75) Inventors: Charles E. Lundy, Jr., Germantown, TN (US); Philip C. Yang, Memphis, TN (US); Richard T. Avent, Memphis, TN (US)

(73) Assignee: Schering-Plough Healthcare Products, Inc., Memphis, TN (US)

( * ) Notice: Subject to any disclaimer, the term of this patent is extended or adjusted under 35 U.S.C. 154(b) by 454 days.

(21) Appl. No.: 11/494,251

(22) Filed: Jul. 27, 2006

(65) Prior Publication Data

US 2007/0022630 A1 Feb. 1, 2007

Related U.S. Application Data

(60) Provisional application No. 60/703,598, filed on Jul. 29, 2005.

(51) Int. Cl.
*A43B 13/38* (2006.01)

(52) U.S. Cl. ..... 36/44; 36/28

(58) Field of Classification Search ..... 36/43, 36/44, 28

See application file for complete search history.

(56) References Cited

U.S. PATENT DOCUMENTS

| | | | | |
|---|---|---|---|---|
| 6,598,321 | B2 * | 7/2003 | Crane et al. | 36/43 |
| 6,723,401 | B1 | 4/2004 | McKnight et al. | |
| 2002/0007569 | A1 * | 1/2002 | Crane et al. | 36/44 |
| 2002/0092203 | A1 * | 7/2002 | Hardt | 36/43 |
| 2003/0070321 | A1 * | 4/2003 | Davis et al. | 36/43 |
| 2005/0039349 | A1 * | 2/2005 | Grisoni et al. | 36/71 |

FOREIGN PATENT DOCUMENTS

| | | | |
|---|---|---|---|
| DE | 297 04 309 | U1 | 7/1998 |
| EP | 0 516 874 | A1 | 12/1992 |
| EP | 1 623 643 | B1 | 2/2006 |

OTHER PUBLICATIONS

International Search Report for PCT/US2006/029591, International Filing Date Jul. 27, 2006, 3 pgs.

* cited by examiner

*Primary Examiner*—Ted Kavanaugh
(74) *Attorney, Agent, or Firm*—Matthew J. Golden

(57) ABSTRACT

An insole for insertion into footwear, comprising a mid-foot portion and a heel portion; the mid-foot portion and heel portion being formed by a cushioning layer of a resilient material having a first hardness and which provides a cushioning function; and a cushioning insert comprised within a recess in said cushioning layer and extending down from said cushioning layer; said cushioning insert comprising a resilient material having a second hardness that is less than the hardness of the hardness of the cushioning layer.

12 Claims, 4 Drawing Sheets

Heel Cross Section

Cross Section

Top View

Bottom View

Arch Cross Section

Fig 4A Heel Cross Section

Fig 4B Cross Section

Fig 4C Cross Section

ARCH SUPPORT INSOLE

This application claims priority from U.S. Provisional Application Ser. No. 60/703,598 filed Jul. 29, 2005, which is incorporated by reference herein in its entirety.

BACKGROUND OF THE INVENTION

The present invention relates generally to shoe insoles or inserts, and more particularly, to insoles adapted for additional arch support and comfort comprising gel material of differing hardness.

Various types of insoles are known which fit within shoes in order to correct various foot problems, alleviate pain and otherwise provide more comfort to the wearer. Examples of such insoles are those sold by the assignee of the present invention under the trademark Dr. SCHOLL'S®.

In particular, U.S. Pat. No. 6,598,321, the entire disclosure of which is hereby incorporated by reference, describes gel insoles with lower heel and toe recesses having thin spring walls. The advance provided by the insoles of that invention is said to be shock absorption upon walking without increasing the energy required to walk.

However it has been surprisingly discovered that an arch support insert comprising thing spring walls comprising a gel material of a different hardness than the gel material of the remainder of the insert provides an improvement in arch support, shock absorption and overall comfort.

SUMMARY OF THE INVENTION

It is object of the present invention to provide an insole that provides support directed to the arch of the foot.

It is another object of the present invention to provide an insole that provides cushioning at the midsole, arch heel areas.

It is a further object of the present invention to provide an insole that tapers in thickness toward the peripheral edges thereof.

It is a yet further object of the present invention to provide an insole that is easy and economical to make and use.

In accordance with one embodiment, the invention provides an insole for insertion into footwear, comprising a mid-foot portion, and a heel portion, said mid-foot portion and heel portion being formed by a cushioning layer of a resilient material having a first hardness and which provides a cushioning function, and a cushioning insert comprised within a recess in said cushioning layer and extending down from said cushioning layer; said cushioning insert comprising a resilient material having a second hardness that is less than the hardness of said cushioning layer.

In accordance with another aspect of the present invention, an insole for insertion into footwear is provided which includes a mid-foot portion and a heel portion; the top surface of which comprises a first elastomeric gel material having a first hardness and the bottom surface of which comprises the first elastomeric gel material and a second elastomeric gel material having a second hardness different from the hardness of the first elastomeric gel material, the second elastomeric gel material located substantially in the mid-foot portion to be positioned below the arch of the foot.

In a preferred embodiment the first elastomeric gel material has a firmer hardness than the second gel elastomeric gel material, whereby the first elastomeric gel material provides shock absorption and support and the second elastomeric gel material provides a cushioning function and additional support.

Preferably, the insole is a three quarter length insole formed from the heel portion to the mid-foot portion. More preferably, the second elastomeric gel material extends from the heel portion to the mid-foot portion, in particular located in an area of the mid-foot portion directly below the arch of the foot when in contact with the insole.

Preferably, the second elastomeric gel material comprises a cushioning insert in the insole, whereby the cushioning insert comprises a plurality of spaced apart spring walls formed from the second elastomeric gel material, the spring walls extending from a lower surface of the cushioning layer. In one embodiment, the spring walls can have a height which is greatest at a center of the cushioning insert and which taper in height toward edges of the cushioning insert. Preferably, each of the spring walls is formed in a generally sinusoidal wave shape.

Preferably, the cushioning insert has a substantially uniform thickness of about 2 mm and the pillow has a height less than about 3 mm above the uniform layer, and the cushioning layer tapers in thickness toward a periphery of the insole.

In one embodiment, the arrangement for maintaining the insole in position can include either an adhesive at a lower surface of the insole, or for example, a non-permanent adhesive that permits removal of the insole from the footwear and repositioning the insole in the footwear, or alternatively, a high friction lower surface of the insole. In another embodiment, a tackifier added to the gel material.

A top cover can also be secured to an upper surface of the cushioning layer.

The above and other features of the invention will become readily apparent from the following detailed description thereof, which is to be read in connection with the accompanying drawings.

DETAILED DESCRIPTION

Figure 1:
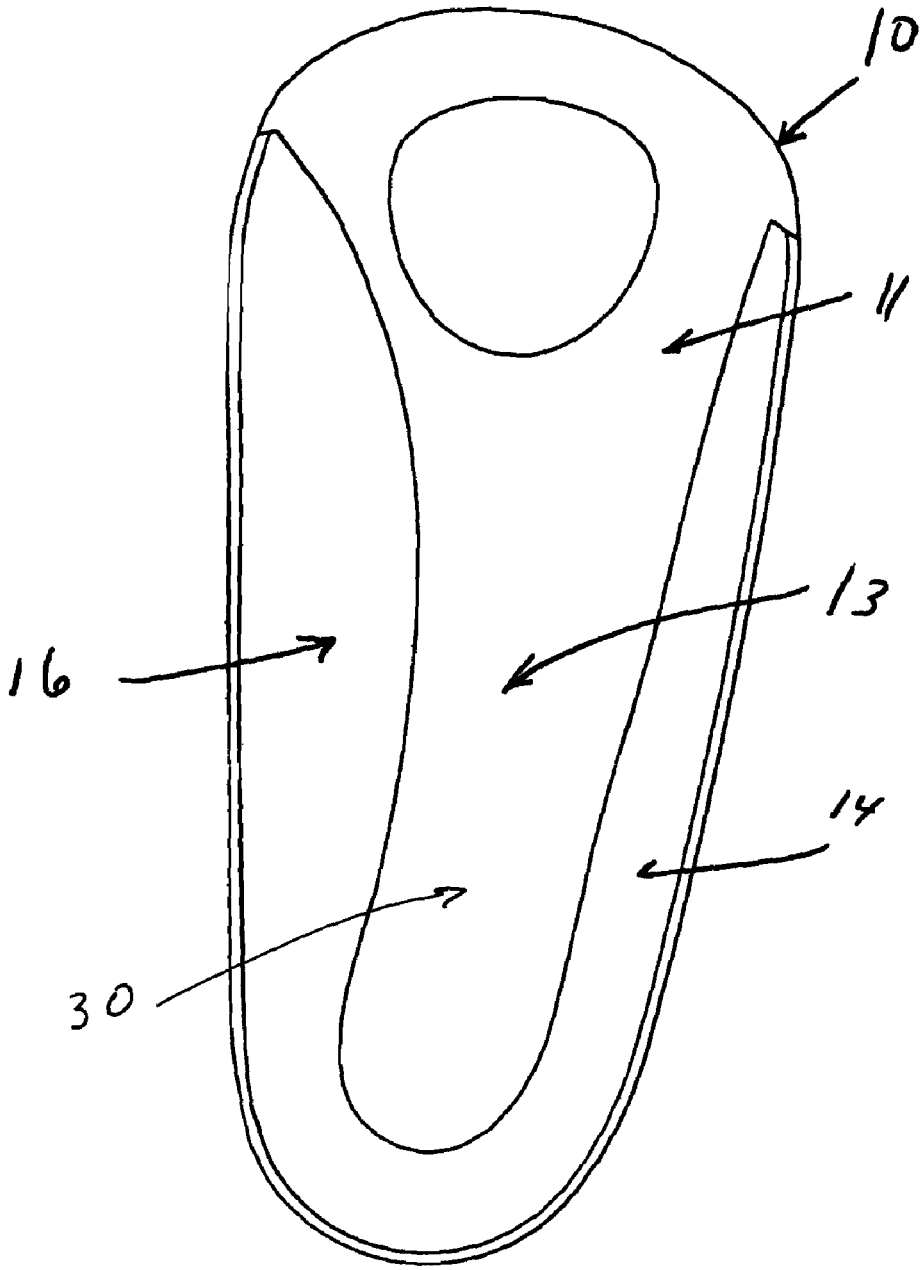
FIG. 1 is a bottom top plan view of a right insole according to one embodiment.

Referring to the drawings in detail, a right insole 10 according to a first embodiment of the present invention is adapted to be placed in an article of footwear, as is well known. A left insole (not shown) is identical to right insole 10 and is a mirror image thereof.

Figure 2:
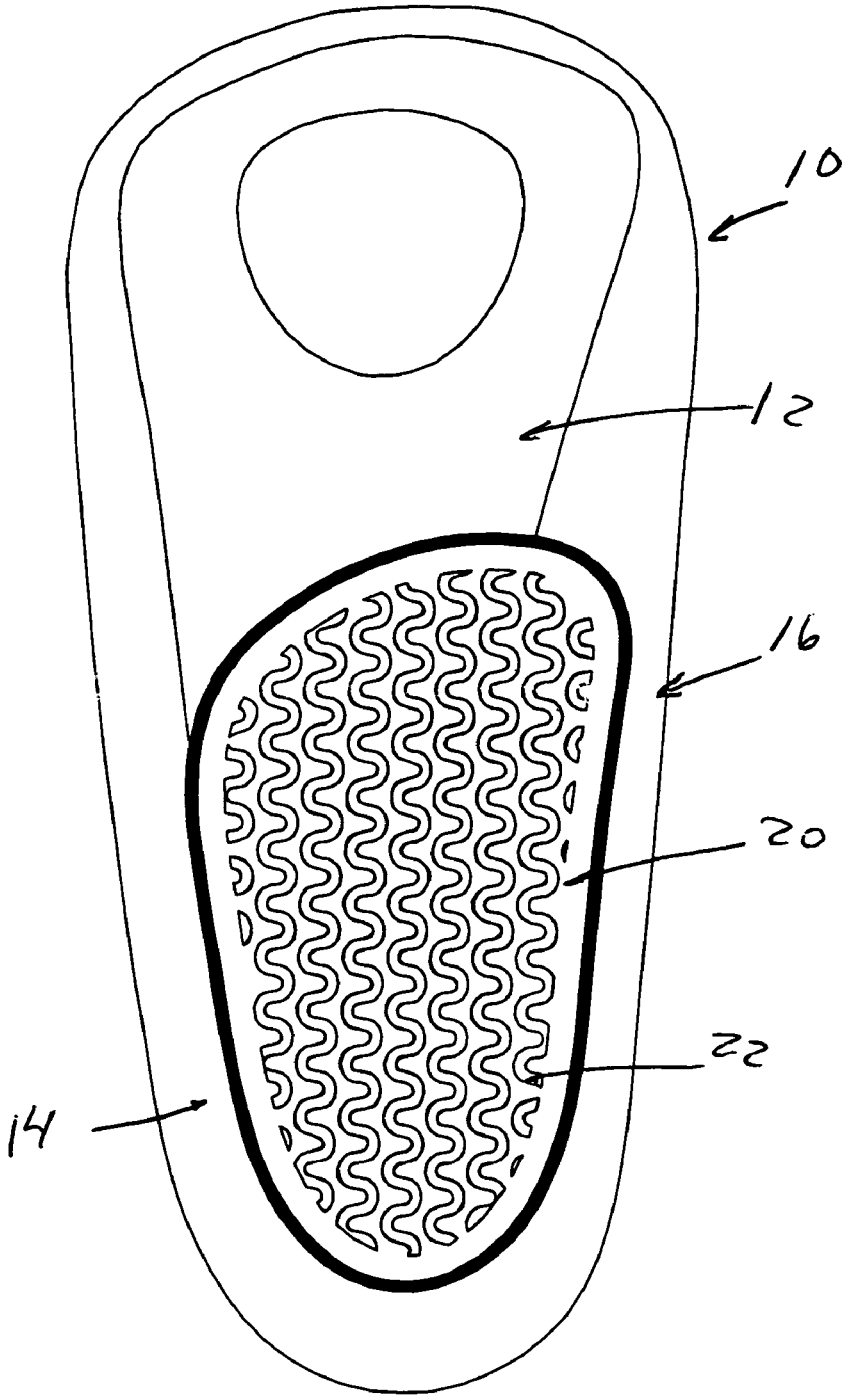
FIG. 2 is a top bottom plan view of a right side insole according to one embodiment.
Figure 3:
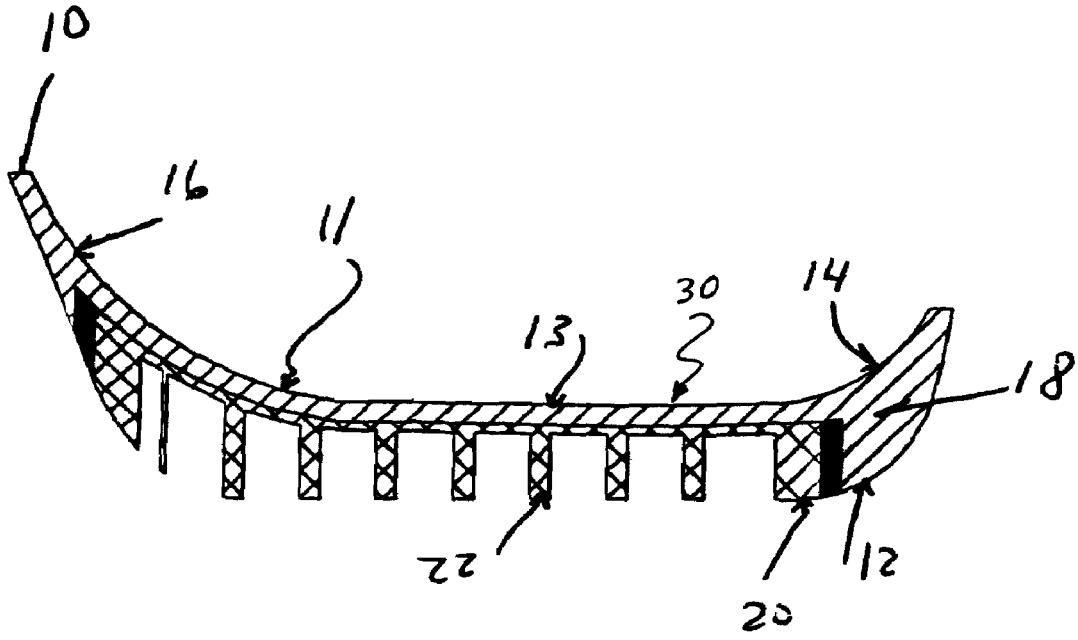
FIG. 3 is a cross sectional view of the arch section of a right insole according to one embodiment.

As seen in FIGS. 1 and 2, insole 10 comprises upper surface 11 and lower surface 12. Upper surface 11 comprises substantially planar center portion 13 and side portions 14 and 16 which form walls curving up from the center portion 13. Side portion 14 represents a lower wall on the edge of insole 10 that comes in contact with the outside of the foot and the heel of the foot and side portion 16 represents a higher wall on the edge of insole 10 that comes in contact with the instep or arch of the foot. Lower surface 12 comprises cushioning insert 20. As seen in FIG. 3, upper surface 11 and lower surface 12 comprises a cushioning layer 18 comprising a first viscoelastic gel material having a first hardness and cushioning insert 20 comprising a second viscoelastic gel material having a second hardness. Accordingly, with insole 10, cushioning insert 20 is provided at the heel and arch of the foot area where most of the impact and forces occur during a gait.

Specifically, in the first embodiment, insole 10 is formed by cushioning layer 18 and cushioning insert 20, each of which is made from a different elastomeric gel material having a different hardness, in particular, the cushioning insert 20 comprising an elastomeric gel material having less hardness than the elastomeric gel material that comprises cushioning layer 18. In effect, cushioning layer 18 and cushioning insert 20 together form a shock absorption and arch support layer that cushions the foot, in order to decrease pressure.

Cushioning layer 18 and cushioning insert 20 can be made from non-foam elastomers such as the class of materials known as viscoelastic polymers, or silicone gels, which show high levels of damping when tested by dynamic mechanical analysis performed in the range of −50 degrees C. to 100 degrees C. Such elastomer materials and methods of manufacturing are described in U.S. Pat. No. 6,598,321, the entire contents of which are incorporated by reference into this specification.

Because the mechanical properties of the gel are more viscous than elastic, the gel provides a high energy absorption. Gels that can be used according to the present invention are thermoplastic elastomers (elastomeric materials), such as materials made from many polymeric families, including but not limited to the Kraton family of styrene-olefin-rubber block copolymers, thermoplastic polyurethanes, thermoset polyurethanes, thermoplastic poly olefins, polyamides, polyureas, polyesters and other polymer materials that reversibly soften as a function of temperature. The preferred elastomers are a Kraton block copolymer of styrene/ethylene-co-butylene/styrene or styrene/butadiene/styrene with mineral oil incorporated into the matrix as a plasticizer, or polyurethane gels.

It will be appreciated that insole 10 is preferably a three quarter length insole, that is, extends along the foot from the heel to the ball of the foot. Typically, insole 10 would be sized corresponding to shoe sizes and would be provided in sized pairs.

Insole 10 can be secured to footwear by using the tack properties of the gel. In this regard, it is preferred that the tack of the gel is enhanced by incorporating a tackifier into the gel composition to increase the friction/tack of the gel surface. Suitable tackifiers include a petroleum hydrocarbon resin sold under the designation I-Mark V by Idemitsu Kosan Co., Ltd. of Tokyo, Japan; the rosin sold under the trademark ASYLVALITE® under designation RE 80 for SEBS gels; and phenolsulfonic acid ester sold under the trademark AMESAMOLL® for a polyurethane (PU) gel. The desired tack is preferably between 120 and 250 grams, as determined by a probe tack tester sold under the trademark APOLYKEN®, at one second contact time.

Figure 4:
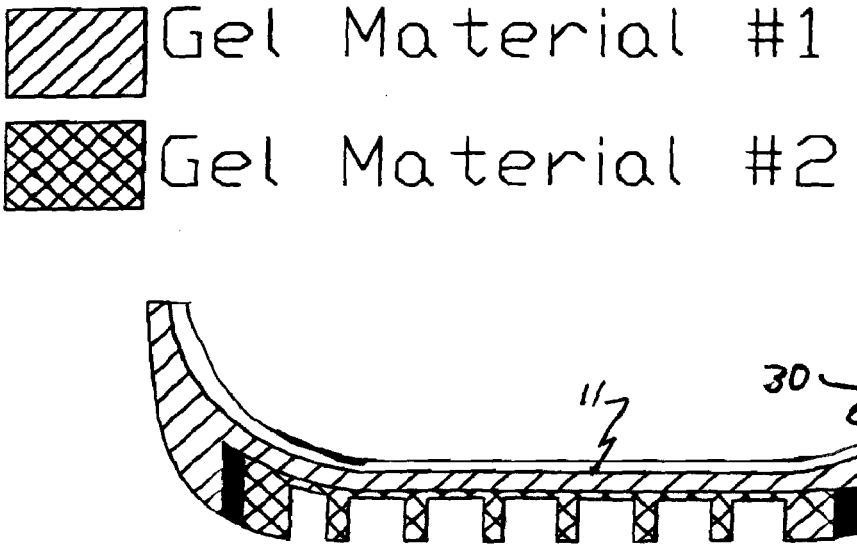
FIGS. 4A-4C are, respectively, the heel portion cross section, length-wise cross section, and mid-foot portion cross section.
Figure 4:
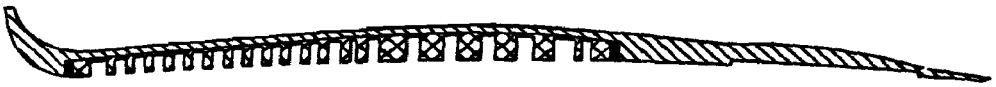
Figure 4:
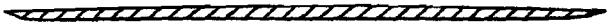

As shown in FIGS. 3 and 4, thin spring walls 22 extend substantially in the lengthwise direction of insole 10 from the forward end to the rearward end of cushion insert 20. The height of spring walls 22 can vary such that spring walls 22 located toward the center of cushion insert 20 have a greater height than spring walls 22 located toward the edges of cushion insert 20, with spring walls 22 therebetween tapering down, as shown best in FIG. 4B. In this manner, the lower ends of spring walls 22 in cushion insert 20 form a substantially dome shape. As a result, the height of spring walls 22 at the center of each pillow can reach a height of about 2-3 mm above the remainder of the insole, which can be about 1-2 mm.

In the embodiment of FIG. 2, thin, spaced apart spring walls 22 are formed as parallel, spaced apart, sinusoidal shaped wave patterns. However, the present invention is not so limited, and can be formed as any of the embodiments described in U.S. Pat. No. 6,598,321. Further, the spacing between thin spring walls 22, the number of spring walls 22, the pitch of the sinusoidal wave patterns in the spring walls 22, etc. may also be varied.

A top cover layer 30, can be secured to the upper surface 11 of the insole, although such a top cover layer is not required. If used, top cover layer 30 can be made from any suitable material including, but not limited to, fabrics, leather, leatherboard, expanded vinyl foam, flocked vinyl film, coagulated polyurethane, latex foam on scrim, supported polyurethane foam, laminated polyurethane film or in-mold coatings such as polyurethanes, styrene-butadiene-rubber, acrylonitrile-butadiene, acrylonitrile terpolymers and copolymers, vinyls, or other acrylics, as integral top covers. Desirable characteristics of top cover layer 30 include good durability, stability and visual appearance. It is also desirable that top cover layer 30 have good flexibility, as indicated by a low modulus, in order to be easily moldable. The bonding surface of top cover layer 30 should provide an appropriate texture in order to achieve a suitable mechanical bond to the upper surface 11. Preferably, the material of top cover layer 30 is a fabric, such as a brushed knit laminate top cloth (brushed knit fabric/urethane film/non-woven scrim cloth laminate) or a urethane knit laminate top cloth. Preferably, top cover layer 30 is made from a polyester fabric material, and preferably has a thickness of about 0.02 inch.

Although the present invention uses the term insole, it will be appreciated that the use of other equivalent or similar terms such as innersole or insert are considered to be synonymous and interchangeable, and thereby covered by the present claimed invention.

Further, although the present invention has been discussed in relation to a removable insole, it can be incorporated as a permanent inner sole in footwear, such as a shoe or the like.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

REFERENCE DESIGNATOR

10 Insole
11 Upper surface
12 Lower surface
13 Center portion
14 Side wall portion (outside and of foot)
16 Side wall portion (arch of foot)
18 Cushioning layer
20 Cushioning insert
22 Spring walls
30 Top cover layer

What is claimed is:

1. A three quarter length insole for insertion into footwear, comprising:

a) a mid-foot portion and a heel portion, said mid-foot portion and heel portion being formed by a cushioning layer of a resilient material having a first hardness and which provides a cushioning function, b) an upper surface comprising a substantially planar center portion and a plurality of side portions curving upwards from said center portion to form walls at the edge of the upper surface, wherein at least one wall contacting the arch of a foot and another wall contacting the outside of a foot, wherein said wall which comes in contact with the arch of a foot extends higher from said center portion than said wall contacting the outside of a foot, and c) a cushioning insert comprised within a recess in said cushioning layer and extending down from said cushioning layer; said cushioning insert comprising a resilient material having a second hardness that is less than the hardness of said cushioning layer, said cushioning insert extending from the heel portion to the mid-foot portion and substantially positioned below the arch of the foot and extending to a portion of the cushioning layer below the wall which comes in contact with the arch of a foot.

2. An insole according to claim 1, wherein the resilient material forming the cushioning layer is a viscoelastic gel material.

3. An insole according to claim 1, wherein the resilient material forming the cushioning insert is a viscoelastic gel material.

4. An insole according to claim 1, which comprises an adhesive at a lower surface of the insole for maintaining said insole in position.

5. An insole according to claim 4, wherein said adhesive is a release adhesive that permits removal of the insole from the footwear and repositioning the insole in the footwear.

6. An insole according to claim 1, which comprises a high friction lower surface of the insole for maintaining said insole in position.

7. An insole according to claim 1, which comprises a tackifier added to said gel material for maintaining said insole in position.

8. An insole according to claim 1, wherein said cushioning insert comprises a plurality of spaced apart spring walls formed from said resilient material, said spring walls extending from a lower surface of said cushioning layer.

9. An insole according to claim 8, wherein said spring walls each have a height which is greatest at a center of said pillow and which tapers in height toward edges of said pillow.

10. An insole according to claim 9, wherein each of said spring walls is formed in a generally sinusoidal wave shape.

11. An insole according to claim 1, wherein said cushioning layer tapers in thickness toward a periphery of said insole.

12. An insole according to claim 1, further comprising a top cover secured to an upper surface of said cushioning layer.

* * * * *